US005330404A

United States Patent [19]

Lopeteguy et al.

[11] Patent Number: 5,330,404

[45] Date of Patent: Jul. 19, 1994

[54] EXERCISE APPARATUS

[76] Inventors: Joe A. Lopeteguy, 2813 Karla St., Bakersfield, Calif. 93312; Mike L. Lopeteguy, 6717 Kimberly Ave., Bakersfield, Calif. 93308

[21] Appl. No.: 24,669

[22] Filed: Mar. 1, 1993

[51] Int. Cl.[5] ..... A63B 21/00; A63B 64/06

[52] U.S. Cl. ..... 482/91; 482/142

[58] Field of Search ..... 482/72, 91, 131, 121, 482/142, 148, 133, 112, 92, 73

[56] References Cited

U.S. PATENT DOCUMENTS

| | | | |
|---|---|---|---|
| 174,738 | 5/1955 | Cowgill | 482/72 |
| 218,624 | 9/1970 | Margolies | 482/72 |
| 2,714,507 | 8/1955 | Goodrich | 482/72 |
| 4,743,010 | 5/1988 | Geraci | 482/72 |
| 4,943,051 | 7/1990 | Haskins et al. | 482/72 |
| 5,039,088 | 8/1991 | Shifferaw | 482/72 |

FOREIGN PATENT DOCUMENTS

| | | | |
|---|---|---|---|
| 498342 | 5/1930 | Fed. Rep. of Germany | 482/72 |

*Primary Examiner*—Richard J. Apley
*Assistant Examiner*—Jerome Donnelly
*Attorney, Agent, or Firm*—Louis J. Bachand

[57] ABSTRACT

An isometric exercise apparatus of the sit-down type having a base and in which footrests carried by a first post pivoted on the base enable isometric resistance to pulling or pushing on a second post intermediately pivoted at the user's seat, the second post being linked to the first post in alternate arrangements of a common link, depending on which muscles are to be exercised.

10 Claims, 2 Drawing Sheets

EXERCISE APPARATUS

TECHNICAL FIELD

This invention relates to exercise apparatus, and more particularly, to an isometric exercise apparatus affording isometric exercise of all major muscles in a simple device which is readily adjustable for different sets of exercises by shifting the point of link attachment on a pivoted post.

BACKGROUND ART

Numerous exercise devices are known, including those disclosed in U.S. Pat. No. 4,300,760 to Bobroff, in U.S. Pat. No. 4,822,038 to Maag, in U.S. Pat. No. 4,784,121 to Brooks, in U.S. Pat. No. 5,104,363 to Shi, in U.S. Pat. No. 4,743,010, to Geraci, in U.S. Pat. No. 4,461,833 to Trethewy, in U.S. Pat. No. 4,248,420 to Hayes, in U.S. Pat. No. 3,792,860 to Selnes, in U.S. Pat. No. 3,446,503, and in U.S. Pat. No. 3,000,632 to Fuchs. None of these devices provide a variety of isometric exercises as a function of different locations of link attachment to a pivoted post.

DESCRIPTION OF THE INVENTION

It is accordingly an object of the invention to provide an exercise apparatus of the isometric type which by a simple adjustment can be used to exercise a wide variety of muscles. It is another object to provide an isometric exercise apparatus in which the upper body muscles are worked against the leg and lower body muscles in an alternating manner dependent on the location of the link attachment.

These and other objects of the invention to become apparent hereinafter are realized in an isometric exercise apparatus having a base, a seat supported on the base for the user, a first endwise pivoted post spaced a first distance from the seat and arranged for outward foot pressure, a second post spaced a second lesser distance from the seat, having upper and lower portions and pivoted therebetween, the second post being arranged for inward or outward arm pressure, and a link linking the first post to the upper or lower portions of the second post for pulling or pushing force respectively on the second post against the resistance of foot pressure on the first post.

In this and like embodiments, the base comprises a longitudinally extended member and a cross member arranged to provide at least three points of contact of the apparatus with its supporting surface, the link is length-adjustable, the second post is pivoted adjacently below and forward of the seat, and there is further included a first cross arm on the first post defining a footrest on either side of the first post, and a second cross arm on the second post defining a hand rest on either side of the second post the first and second cross arms lying in generally parallel planes.

In a preferred embodiment, the base, link and first and second posts define a four-bar linkage with alternate locations of the link bar on the second post, there is further included a seat pedestal supporting the seat on the base, the seat pedestal including a third post extending vertically from the base, and a seat support cantilevered from the third post, the second post being pivoted on the seat support, there is further included a plurality of pivot mounts for the first post, each differently spaced from the seat, and a plurality of pivot mounts for the second post, each differently spaced from the first post, whereby the apparatus is adjustable for different users, the base comprises a longitudinally extended member and a cross member arranged to provide at least three points of contact of the apparatus with its supporting surface, the link is length-adjustable, and the second post is pivoted adjacently below and forward of the seat.

In a highly preferred embodiment of the apparatus, there is provided an isometric exercise apparatus having a longitudinally extended base comprising forward and rearward portions arranged to stably support the apparatus on a floor, the base forward portion having a first pivot mount thereon; a seat pedestal fixed to the base rearward portion; a seat mounted on the seat pedestal; a second pivot mount carried forwardly on the seat pedestal below the seat; a first post pivotally mounted endwise to the pivot mount and extending generally vertically therefrom, the first post having a first post cross arm arranged to receive the feet of a user seated on the seat; a second post pivotally mounted intermediate its ends on the second pivot mount and extending generally vertically therefrom in the same vertical plane as the first post, the second post having a second post cross arm generally in a horizontal plane parallel to the horizontal plane of the first cross arm, the second cross arm being arranged to receive the hands of a user, the second post having third and fourth pivot mounts at upper and lower ends thereof respectively; a link arm pivotally mounted to the first pivot mount and to the second or third pivot mounts alternatively for isometric exercise either by pulling with the arms on the second post cross arm with the link extending between the second post and the third pivot mount or pushing on the second post cross arm with the link extending between the second post and the fourth pivot mount, each while the user's feet push against the first cross arm in isometric resistance to movement of the second cross arm by pulling or pushing respectively, whereby different groups of muscles are exercised in response to location of the link on the first post and the use of pulling or pushing movement of the arms.

BRIEF DESCRIPTION OF THE DRAWINGS

The invention will be further described in conjunction with the attached drawings in which.

BEST MODE FOR CARRYING OUT THE INVENTION

Figure 1:
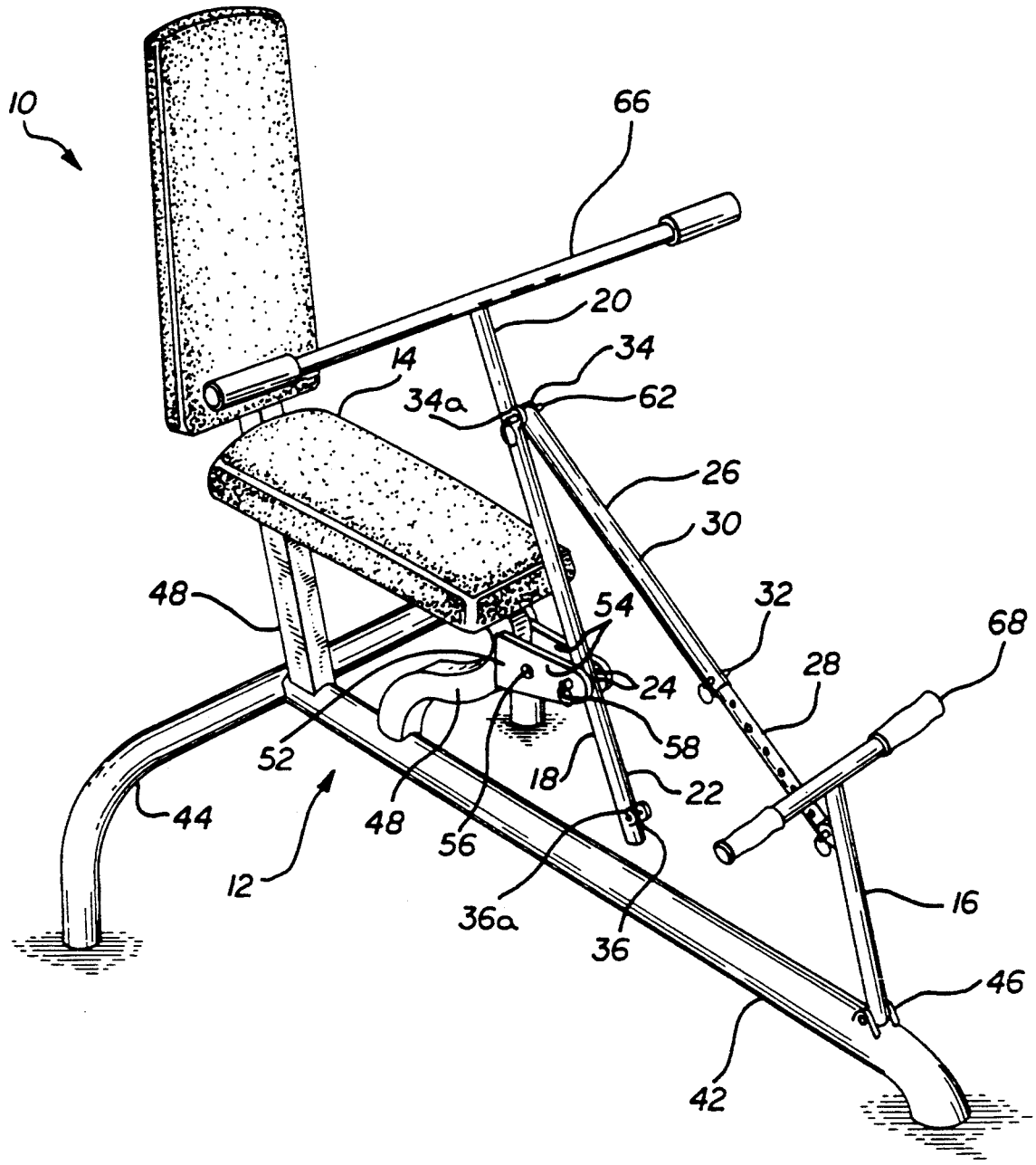
FIG. 1 is a perspective view of the invention apparatus, with the link in a first position for exercises involving pulling with the arms against resistance of the legs.
Figure 2:
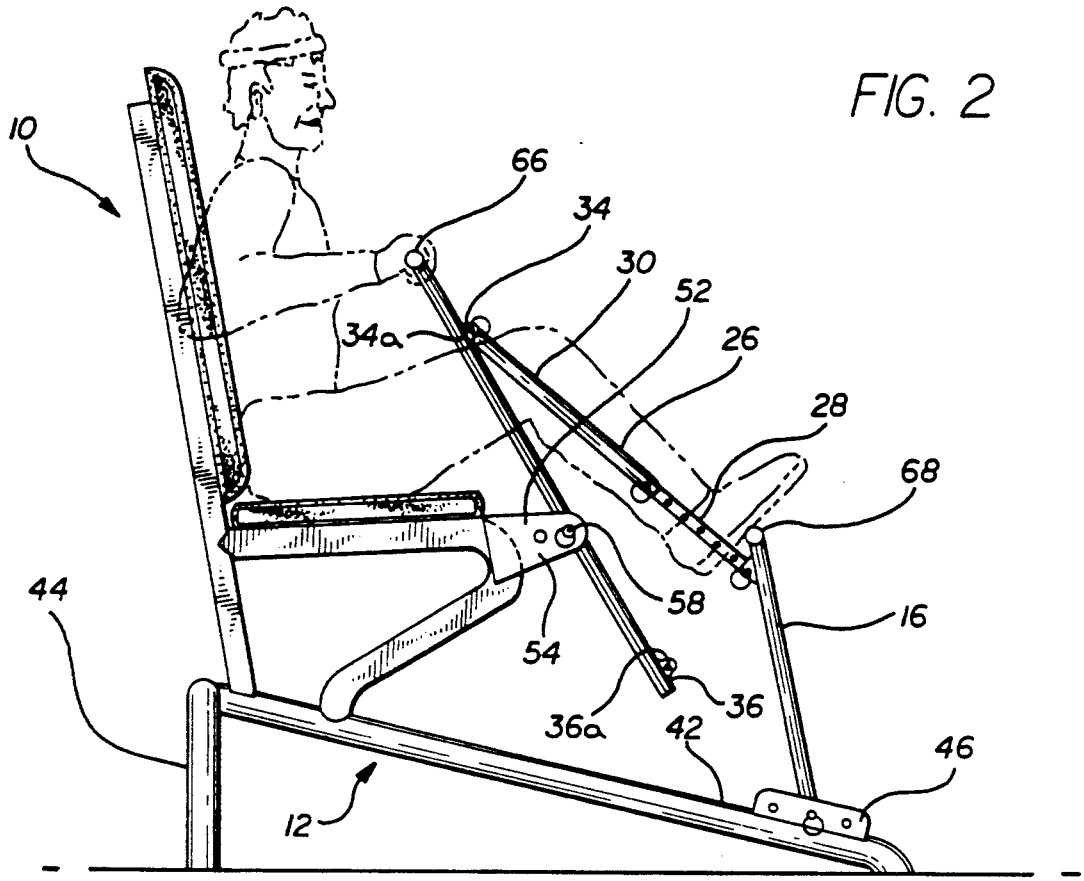
FIG. 2 is a side elevation view of the apparatus.
Figure 3:
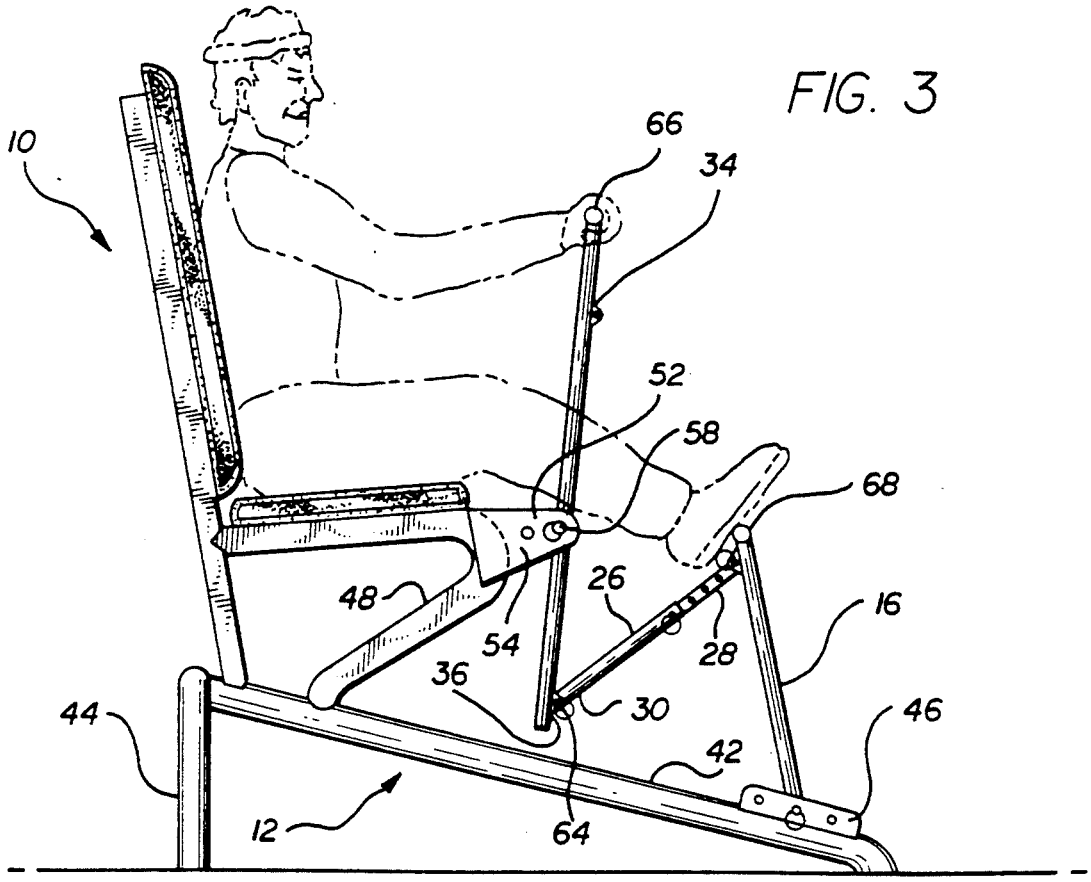
FIG. 3 is a view like FIG. 2, with the link in a second position for exercises involving pushing with the arms against resistance of the legs.

With reference to FIGS. 1–3, the apparatus is shown at 10 and includes a base 12, a seat 14, and a first endwise pivoted post 16, spaced a distance from the seat, as shown, for comfort of the user. The apparatus further includes a second post 18 which is spaced a lesser distance, as shown, from the seat 14. The second post 18 has upper portion 20 and lower portion 22 and is pivoted at 24 between the upper and lower portions. A link 26, comprising a rigid bar having telescoping inner section 28 and outer section 30 perforated for mutual registration in different degrees of extension and held by pin 32 is pivotally mounted on second post 18 at the upper portion 20 thereof in FIGS. 1 and 2 and at the lower portion 22 thereof in FIG. 3, for purposes to appear. The link 26 in FIGS. 1 and 2 is connected to the second post at 34, above the pivot 24 and this arrangement adapts the apparatus for arm pulling exercises. In the position shown in FIG. 3, the link 26 is connected at 36 below the pivot 24, and this arrangement adapts the apparatus for arm pushing exercises. In both instances the exercise is isometric with the legs as will be described.

The apparatus base 12 comprises a longitudinally extended member 42 and a cross member 44, welded or otherwise secured together and arranged to provide a three point contact of the apparatus to the floor surface (not shown). The first post 16 is pivoted between ears 46 mounted on member 42 (shown to be longitudinally adjustable in FIGS. 2 and 3). A third post 48 is rises from the member 42 and forms a bracket for seat 14. Post 48 is curved to extend slightly forward of the seat 14, and carries a bracket 52 comprising spaced flanges 54, through one of a pair of registered openings 56 in which a removable pin 58 extends. Second post 18 has a transverse opening (not shown) adapted to receive the pin 58 when the second post 18 is positioned between flanges 54, thus to be pivoted for rocking about the pin 58 just before the seat 14.

Link 26 connects by pin 62 to mounting ears 34*a* at 34 on the second post 18 or by pin 64 to mounting ears 36*a* at 36 on second post 18. In the former position, the user exercises by grasping with the hands upper cross bar 66 and pulling against the force of the legs applied by the user's feet to the lower cross bar 68. The upper cross bar 66 is returned to position by letting the legs overpower the arms, and the pulling exercise is repeated.

With reference to FIG. 3, the link 26 is mounted between ears 36*a* on second post 18 and the first post. In this alignment, the apparatus is set up for pushing exercises with the arms. The hands grasp the upper cross bar 66 as before but because the link 26 is on the opposite side of the pivot 24, the leg resistance is felt during a pushing motion rather than a pulling motion.

In both configurations, the leg force is kept in balance with the arm force and the muscles involved in the respective pushing and pulling motions and leg resistance are toned isometrically.

The apparatus is advantageous is being simple in construction, widely variable in exercises performable, adaptable to different size individual with easy adjustments, low in cost and free of complexities of pulleys and free weights.

We claim:

1. An isometric exercise apparatus having a base, a seat, a seat pedestal, supporting said seat on said base seat, a first endwise pivoted post spaced a first distance from said seat, a first cross arm on said first post defining a foot rest on either side of said first post arranged for outward foot pressure, a second post spaced a second lesser distance from said seat, having upper and lower portions and pivoted therebetween, a second cross arm on said second post defining a hand rest on either side of said second post arranged for inward or outward arm pressure, said first and second cross arms lying in generally parallel planes, and a link linking said first post to the upper or lower portions of said second post for pulling or pushing force respectively on said second post against the resistance of foot pressure on said first post, said seat pedestal comprising a third post rigidly attached to and extending from said base and a seat support, said second post being pivoted on said seat support.

2. The isometric exercise apparatus according to claim 1, in which said base comprises a longitudinally extended member and a cross member arranged to provide at least three points of contact of the apparatus with its supporting surface.

3. The isometric exercise apparatus according to claim 1, in which said link is length-adjustable.

4. The isometric exercise apparatus according to claim 1, in which said second post is pivoted adjacently below and forward of said seat on said seat support.

5. The isometric exercise apparatus according to claim 1 in which said base, link and first and second posts define a four-bar linkage with alternate locations of the link bar on the second post.

6. The isometric exercise apparatus according to claim 1, including also a plurality of pivot mounts for said first post, each differently spaced from said seat, and a plurality of pivot mounts for said second post, each differently spaced from said first post, whereby said apparatus is adjustable for different users.

7. The isometric exercise apparatus according to claim 1, in which said base comprises a longitudinally extended member and a cross member arranged to provide at least three points of contact of the apparatus with its supporting surface.

8. The isometric exercise apparatus according to claim 7, in which said link is length-adjustable.

9. The isometric exercise apparatus according to claim 8, in which said second post is pivoted adjacently below and forward of said seat on said seat support.

10. An isometric exercise apparatus having a longitudinally extended base comprising forward and rearward portions arranged to stably support said apparatus on a floor, said base forward portion having a first pivot mount thereon; a seat pedestal fixed to said base rearward portion; a seat mounted on said seat pedestal; a second pivot mount carried forwardly on said seat pedestal below said seat; a first post pivotally mounted endwise to said first pivot mount and extending generally vertically therefrom, said first post having a first post cross arm arranged to receive the feet of a user seated on said seat; a second post pivotally mounted intermediate its ends on said second pivot mount and extending generally vertically therefrom in the same vertical plane as said first post, said second post having a second post cross arm generally in a horizontal plane parallel to the horizontal plane of said first cross arm, said second cross arm being arranged to receive the hands of a user, said second post having third and fourth pivot mounts at upper and lower ends thereof respectively; a link arm pivotally mounted to said first pivot mount and to said third or fourth pivot mounts alternatively for isometric exercise either by pulling with the arms on said second post cross arm with said link extending between said second post and said third pivot mount or pushing on said second post cross arm with said link extending between said second post and said fourth pivot mount, each while the user's feet push against said first cross arm in isometric resistance to movement of said second cross arm by pulling or pushing respectively, whereby different groups of muscles are exercised in response to location of said link on said first post and the use of pulling or pushing movement of the arms.

* * * * *